United States Patent [19]

Perry

[11] Patent Number: 4,932,669

[45] Date of Patent: Jun. 12, 1990

[54] METHOD OF PLAYING A MULTIPLE PLAYER CHESS GAME

[76] Inventor: John T. Perry, 7406 S. Victor, Apt. 1616, Tulsa, Okla. 74136

[21] Appl. No.: 332,334

[22] Filed: Apr. 3, 1989

[51] Int. Cl.[5] ..... A63F 3/02

[52] U.S. Cl. ..... 273/261; D21/24

[58] Field of Search ..... 273/260, 261; D21/24

[56] References Cited

U.S. PATENT DOCUMENTS 3,627,324 12/1971 Krepp ..... 273/260

4,778,187 10/1988 Deak ..... 273/261

OTHER PUBLICATIONS

John Gollon, Chess Variations "Double Chess", pp. 203–208, 1968.

*Primary Examiner*—Benjamin Layno

[57] ABSTRACT

A method of playing chess for two, three or four persons, the game comprises a playing board having a checkerboard array of rows of squares. Four additional playing areas are contiguous with the four sides of the checkerboard and conventional chess pieces are staged in conventional layout within the additional playing areas. Each set of chess pieces including distinguishing characteristics, such as color, for differentiation. The pawns initially move forward as in conventional chess, however, to provide for additional chess strategy the pawns may change to a second direction of forward movement by capturing an opponent on the side of the second direction on any space on the game board. The pawn may then continue to move forward in this second direction, which is a 90° change in direction. Each pawn can be provided with a mechanism for indicating which direction the pawn can move and attack. The game is played conventionally except as modified as described above.

2 Claims, 1 Drawing Sheet

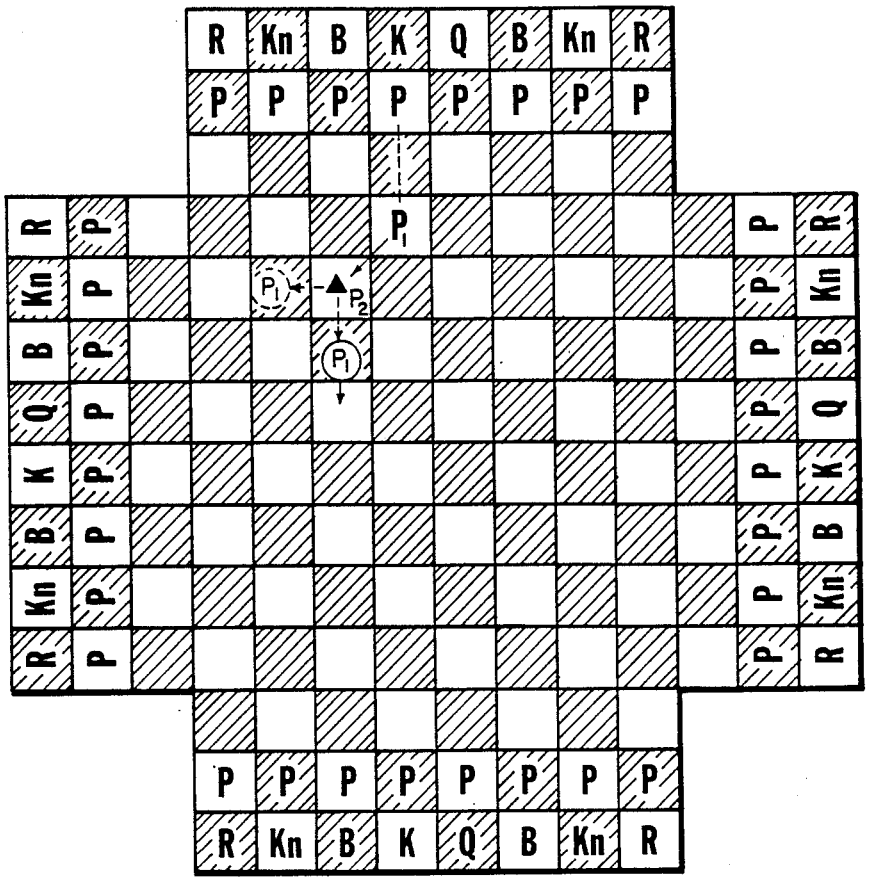
R Kn B K Q B Kn R
P P P P P P P P
R P P1 P R
Kn P P1 P2 P Kn
B P P1 P B
Q P P Q
K P P K
B P P B
Kn P P Kn
R P P R
P P P P P P P P
R Kn B K Q B Kn R

METHOD OF PLAYING A MULTIPLE PLAYER CHESS GAME

BACKGROUND OF THE INVENTION

1. Field of the Invention

The present invention relates to a chess game playable by two, three or four persons and, more particularly, to such a game where it can be played conventionally or as teams, and with modified attack rules.

2. Setting of the Invention

Chess games for more than two players are well known; examples are disclosed in the following U.S. Pat. Nos. 3,843,130; 4,147,360; 4,190,254; 4,696,478 and 4,708,349. All of these games provide a checkerboard pattern playing surface, some with additional staging and/or playing areas. Further, these games include many variations to the conventional chess roles to add something different to the game. Many of these games have substantially altered the chess rules which can be difficult to learn and remember during the game, thus distracting from the pleasure of playing. It is desirous to maintain as much of the conventional chess strategy and rules as possible for play with more than two players.

British Patent No. 1,030,519 and U.S. Pat. No. 4,147,360 permit pawns to alter their direction of travel and thus their direction of attack. In the above patents, multiple players will tend to use these altered rights of the pawns as a "free-for-all" where the pawns can attack in any oblique direction. This alteration reduces the conventional opening movements of the chess game and can thus reduce the enjoyment of the strategy of chess.

There is a need for a multiple (such as from two to four) player chess game which preserves as much of the chess strategy as possible yet provides meaningful variations to the conventional rules for added enjoyment.

SUMMARY OF THE INVENTION

A chess game is provided for play by two, three or four persons according to only slightly modified conventional rules. The game board is of conventional checkerboard design but includes four contiguous playing areas for staging the sets of playing pieces. The sets are provided with mechanisms for differentiation, such as by color, for identification of each player's or team's pieces. To provide for additional chess strategy, the pawns may change their direction of foward movement, to another direction of forward movement by capturing an opponent on the side the new direction of travel will be. The pawn must then continue in a forward motion in the new direction along a 90° plane from where the pawn had previously advanced. To assist in the player remembering what path the pawn can travel, a mechanism can be provided for indicating the direction, such as an arrow or pointer incorporated on the pawns.

BRIEF DESCRIPTION OF THE DRAWINGS

FIG. 1 is a plan view of a chess board embodying the present invention with positions indicating the placement of the chess pieces, and dashed lines indicating an advance, attack and change of direction of a pawn.

DETAILED DESCRIPTION OF THE PREFERRED EMBODIMENTS

The chess game of the present invention utilizes a chess board as shown in FIG. 1 wherein eight rows of eight alternating light/dark squares form a typical chess board with additional playing areas which contiguously extend from each of the four sides. The additional playing areas include three rows of eight alternating light-/dark squares. Each additional playing area can include a different colored border to indicate the home territory of each player. As indicated in FIG. 1, two, three or four players arrange their conventional chess playing pieces in a conventional layout within the last two laterally extending rows of each additional playing area. Each set of chess pieces is distinguishable one from another by color, shape or size, and each set includes eight pawns, two rooks, two knights, two bishops, one queen and one king.

Play procceds by conventional chess rules except as follows:

(a) any player controlling a light colored chess set can open but then opening movement proceeds therefrom around the board clockwise;

(b) during individual play, one or more players can combine their forces to place another player into check or checkmate;

(c) when a player's king is placed in checkmate, that player's remaining pieces are prevented from moving, or, in a variation, can continue to move to avoid capture but cannot capture pieces until the king moves from being in checkmate or the pieces placing the king in checkmate are captured by another or are moved;

(d) during play with four players, two players sitting opposite from one another can become teammates with the two sets acting in unison against the other two sets; and (e) pawns move forward from their starting position and can change to a second direction of forward movement by capturing an opponent on the oblique side of the second direction on any space on the game board. This 90° change in direction must follow along the 90° plane until another capture allows the pawn to alter its direction or until the pawn is exchanged for a queen when it reaches the last row of an opponent.

In the chess game of the present invention the pawns can include an indication of their direction of travel, such as an arrow, pointer, a dual colored disk having the two opposite colors to/from which the pawn can move to/from, or any other mechanism to indicate direction of travel.

Wherein the present invention has been described in particular relation to the drawings attached hereto, it should be understood that other and further modifications apart from those shown or suggested herein can be made within the scope and spirit of the present invention.

What is claimed is:

1. A method of playing chess with a game board and a plurality of distinguishable sets of playing pieces, the game board comprising a four sided main playing area defined by an eight square matrix of alternately colored playing spaces, and extensions extending from each side of the main playing area, each extension being comprised of rows of alternately colored spaces defining a plus-shaped area, each set of playing pieces comprising conventional chess playing pieces that include a plurality of pawns, knights, rooks, and bishops as well as king and queen; said method comprising the steps of: placing playing pieces on the game board so that each player's playing pieces occupy a different extension and so that each player's playing pieces occupy the two rows of spaces on the extension that are located farthest from the main playing area; each player, in turn, moving one of the playing pieces from one space on the board to another according to certain restrictions on the movement capabilities of each piece; any player during a turn and when desired, moving a playing piece to a space occupied by an opponent's piece and subsequently thereto, removing the opponent's pieces as an indication that the opponent's piece has been captured; each player's pawn moving in a first direction can capture an opponent's piece on a diagonal from any space on the game board and then the pawn can advance in the first direction or in a second direction 90° from the first direction; and when a player's king is checkmated, remaining playing pieces of the player's can move to evade capture without the power to capture.

2. The method of claim 1 and including after a pawn has changed to the second direction of advancement, moving an indicator on the pawn to indicate its new direction of advancement.

* * * * *